US005803052A

United States Patent [19]

Lorraine et al.

[11] Patent Number: 5,803,052

[45] Date of Patent: Sep. 8, 1998

[54] SPRING CLIP FOR RETAINING A FUEL INJECTOR IN A FUEL RAIL CUP

[75] Inventors: Jack R. Lorraine, Newport News; Ronald G. Fly, Yorktown, both of Va.

[73] Assignees: Siemens Automotive Corporation, Auburn Hills; Ford Motor Co., Dearborn, both of Mich.

[21] Appl. No.: 884,370

[22] Filed: Jun. 27, 1997

[51] Int. Cl.[6] ..... F02M 55/02

[52] U.S. Cl. ..... 123/470; 123/456

[58] Field of Search ..... 123/470, 472, 123/456, 469, 468

[56] References Cited

U.S. PATENT DOCUMENTS

| | | | |
|---|---|---|---|
| 4,993,390 | 2/1991 | Ono et al. . | |
| 5,035,224 | 7/1991 | Hornby et al. . | |
| 5,040,512 | 8/1991 | Twilton . | |
| 5,136,999 | 8/1992 | Bassler et al. . | |
| 5,167,213 | 12/1992 | Bassler et al. . | |
| 5,211,149 | 5/1993 | DeGrace, Jr. . | |
| 5,350,314 | 9/1994 | Saba . | |
| 5,501,195 | 3/1996 | Hall . | |
| 5,520,151 | 5/1996 | Gras et al. . | |
| 5,598,824 | 2/1997 | Treusch | 123/470 |

FOREIGN PATENT DOCUMENTS

| | | | |
|---|---|---|---|
| 9015240 | 12/1990 | WIPO | 123/470 |

*Primary Examiner*—Carl S. Miller

[57] ABSTRACT

A spring clip for retaining together a fuel injector and a fuel rail cup includes first and second parallel spaced side walls and a third side wall resiliently connecting the first and second side walls to form a generally U-shaped body with an open side. The first and second parallel spaced side walls include flanges extending inwardly toward one another from opposed lower edges of the side walls. The flanges are configured to coact with an exterior surface of an associated fuel injector to locate the injector axially relative to the clip. The first and second parallel spaced side walls also include slots arranged to receive a flanged portion of the fuel rail cup such that the clip is located axially relative to the cup, thereby locating said injector axially relative to said cup. An aperture in the third side wall receives both a radially protruding orientation key of the injector and a corresponding orientation key of the fuel rail cup to fix the injector against rotational motion in the cup. Angled upper edges of the side walls and the side wall aperture allow the clip to be radially installed on the injector and to thereafter permit axial connection of the clip with the fuel rail cup when the injector inlet end is inserted into the cup. Alternatively, when the injector is assembled in the fuel rail cup, the clip may be snapped onto the assembly. In either case, the clip fixes the injector against axial and rotational movement relative to the fuel rail cup.

7 Claims, 1 Drawing Sheet

SPRING CLIP FOR RETAINING A FUEL INJECTOR IN A FUEL RAIL CUP

FIELD OF THE INVENTION

This invention relates to the assembly of a fuel injector in a fuel rail cup and more particularly to an improved clip for retaining an associated fuel injector in a corresponding fuel rail cup against axial and relative circumferential rotation.

BACKGROUND OF THE INVENTION

It is known in the art relating to the assembly of a fuel injector in a fuel rail cup to use a U-shaped spring clip as the connecting member. In current assemblies, where split or bent stream fuel delivery is employed, it is necessary to provide accurate fuel injector orientation relative to the fuel rail cup. Such accurate injector orientation must be maintained in service.

Several arrangements of clip, fuel injector and fuel rail cup connections have been employed.

One type of arrangement provides a flat portion of a lower clip groove in an injector, or a radially extending flat portion of an injector, that engages with a corresponding flat portion of the clip. This engagement with the flat portion is intended to prevent the injector from rotating to ensure correct targeting of the fuel spray. However, upon repeated turning of the injector, the flats on the injector or radially extending portion become worn away and the injector becomes misaligned.

In other arrangements, the spring clip includes raised tangs formed in the clip which engage a corresponding feature on the fuel injector and fuel rail cup to orient the injector in the cup. The application of rotational force to the injector in this arrangement has been found to cause the tangs to bend and allow the injector to become misaligned in service.

In current arrangements, an injector orifice is oriented relative to an electrical connector. The electrical connector is referenced to a clip groove in the injector and the injector clip is oriented by the clip groove. Features within the clip relate the clip groove location feature to the clip sides. The clip sides are located to a tab on the injector cup, and the injector cup is oriented to the fuel rail mounting feature, such as screw holes. The fuel rail is oriented to the manifold and the manifold is oriented to the head and eventually to the inlet valves, the desired target. This arrangement results in a large cumulative alignment tolerance. Location is limited by the feature easiest overcome which is the clip to clip groove interface which provides generally about 11 to 15 in.lb. of resistance torque for first time rotation. Once the injector has been rotated, the resistance to subsequent rotations drops off significantly.

SUMMARY OF THE INVENTION

The present invention provides an improved spring clip for retaining together a fuel injector and a fuel rail clip that fixes an associated fuel injector against axial and rotational movement relative to a corresponding fuel rail cup. More specifically, the spring clip of the invention includes a key feature or aperture for receiving, and retaining therein, corresponding radially protruding keys of an injector and a fuel rail cup, which provides superior resistance to rotation of the injector in the fuel rail cup.

In carrying out the invention, the spring clip includes first and second parallel spaced side walls and a third side wall resiliently connecting the first and second side walls to form a generally U-shaped body with an open side. The first and second parallel spaced side walls include flanges extending inwardly toward one another from opposed lower edges of the side walls. The flanges are configured to coact with an exterior surface of an associated fuel injector to locate the injector axially relative to the clip. The first and second parallel spaced side walls also include slots arranged to receive a flanged portion of the fuel rail cup such that the clip is located axially relative to the cup, thereby locating said injector axially relative to the cup. An aperture in the third side wall receives both a radially protruding orientation key of the injector and a corresponding orientation key of the fuel rail cup.

When the injector is assembled in the fuel rail cup, the clip may be snapped onto the assembly to fix the injector against axial and rotational movement relative to the fuel rail cup. However, in the preferred embodiment illustrated, the clip is designed so that it may be first mounted on the injector in its proper position. Then the injector with the clip attached is inserted into the fuel rail cup and the clip snaps over the cup flanges while its radially protruding key is guided into the orienting aperture of the spring clip. This mode of installation is made possible by outwardly angled upper positions of the three side walls of the clip. These allow the parallel side walls to spring out to allow entry of the fuel rail cup flange while the key portion of the cup enters the clip aperture through a radially extended portion formed by outward angling of the aperture upper edge with the upper portion of the third side wall in which the aperture is formed.

In this arrangement, the aperture in the third side wall of the clip is in the planes of the third side wall. The aperture surrounds the protruding keys of an injector and fuel rail cup providing a large perimeter of engagement within the third side wall. The aperture in the third side wall thereby prohibits rotation of the fuel injector relative to the fuel rail cup as any rotational force applied to the injector is constrained by the aperture in the third side wall. In a conventional clip, orientation tangs can bend and orientation features can become worn allowing relative rotation of the injector in the fuel rail cup resulting in misalignment of the injector in the cup.

These and other features and advantages of the invention will be more fully understood from the following detailed description of the invention taken together with the accompanying drawings.

DETAILED DESCRIPTION OF THE INVENTION

Figure 1:
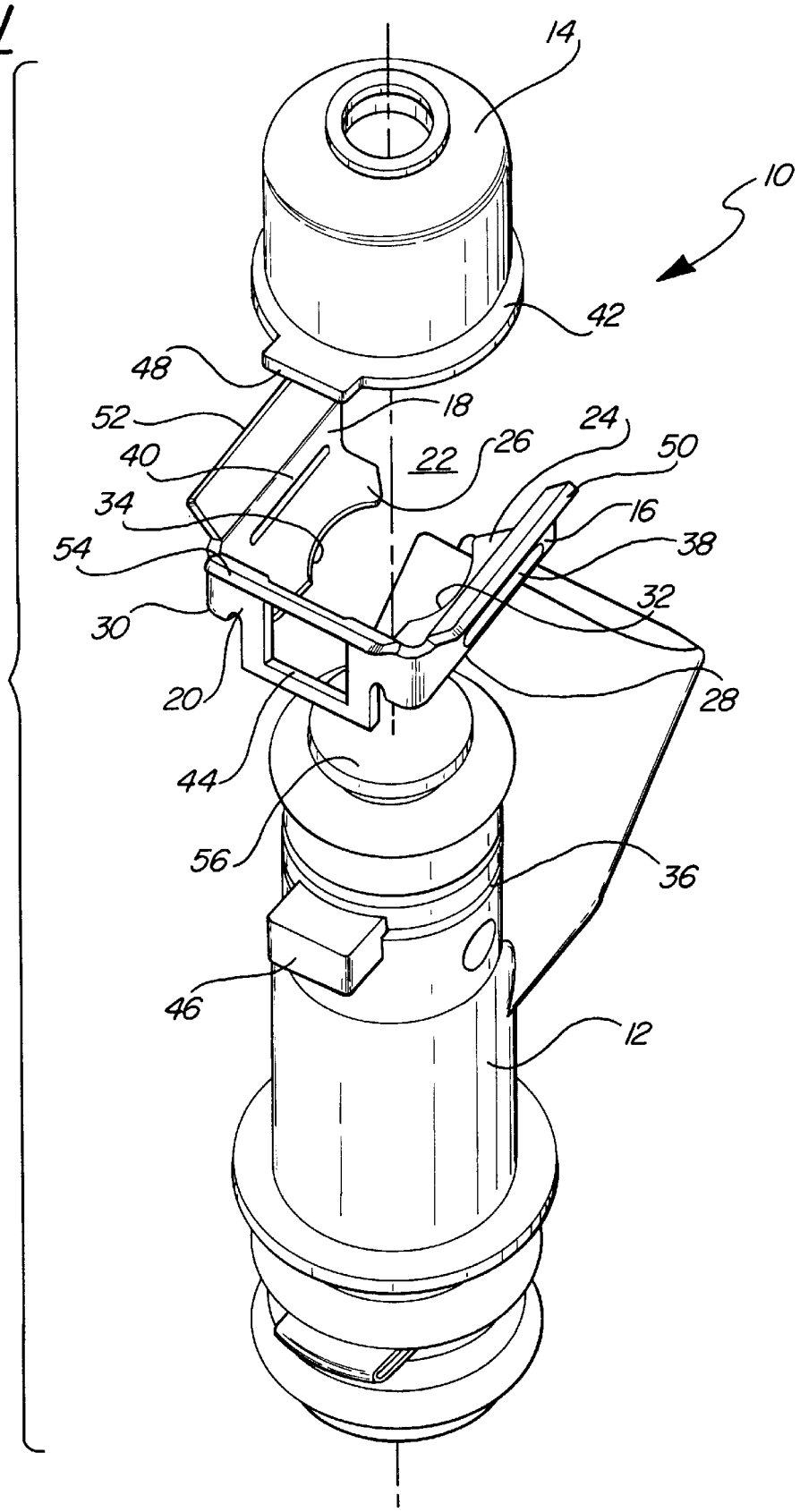
FIG. 1 is an exploded perspective view of an assembly comprising a fuel injector, fuel rail cup and a spring clip constructed in accordance with the present invention.

Referring now to the drawings in detail, a spring clip constructed in accordance with one embodiment of the present invention is generally indicated by reference numeral 10 and is used for retaining together an associated fuel injector 12 and a fuel rail cup 14. As is hereinafter more fully described, the spring clip 10 provides improved retention of the fuel injector 12 in the fuel rail cup 14, fixing the injector against axial and rotational movement relative to the fuel rail cup.

As illustrated in FIG. 1, clip 10 includes first and second parallel spaced side walls 16,18 which in the assembly extend axially of the axis of the injector 12 and are disposed on diametrically opposite sides of the injector. A third side wall 20, resiliently connects the first and second side walls 16,18 and also extends axially of the axis of the injector 12. The first, second and third walls 16,18,20 form a generally U-shaped body with an open side at 22 that is diametrically opposed to third side wall 20 and that allows the side walls 16,18 of clip 10 to spring outward to be received over the injector 12 and the fuel rail cup 14 when assembled.

The first and second parallel spaced side walls 16, 18 include flanges 24,26 extending inwardly toward one another from opposed lower edges 28,30 of the side walls. The flanges 24,26 include arcuate inner edges 32, 34 which are configured to coact with an exterior surface feature or injector groove 36 of the fuel injector 12 to locate the injector axially relative to the clip 10. Herein edges 32,34 are arcuate and locate in a circumferential groove that defines surface feature 36.

The first and second parallel spaced side walls 16,18 include slots 38, 40 disposed parallel with each other and transverse to the axis of the injector arranged to receive a flanged portion 42 of the fuel rail cup 14. Slots 38,40 locate clip 10 axially relative to the cup 14, thereby locating the fuel injector 12 axially relative to the cup. The third side wall 20 includes an aperture 44 for receiving both a radially protruding orientation key or injector key 46 of the fuel injector 12 and a corresponding orientation key 48 of the fuel rail cup 14. Aperture 44 is illustrated as being generally rectangular in shape although other shaped apertures can also be used. The orientation keys 46,48, when angularly aligned, provide proper rotational locating of the injector 12 in the fuel rail cup 14.

Preferably, the side walls 16,18,20 of the clip 10 include angled upper portions 50,52,54 which are angled outwardly to provide for a preferred method of assembly. The upper part of aperture 44 is also angled outward with the upper portion 54 to assist the assembly process. As illustrated, the cross sectional shape of the protruding orientation keys 46,48 generally corresponds to the shape of aperture 44 for mating relationship. The clip 10 may be made of plastic or metal material provided the material has sufficient resiliency to maintain its U-shape.

Assembly of the fuel injector 12 into the fuel rail cup 14 is accomplished by axially advancing the inlet end 56 of the injector into the fuel rail cup until the corresponding orientation keys 46,48 are in engaged alignment, assuring that the injector is properly positioned rotationally (or angularly) in the fuel rail cup.

In a preferred method of assembly, the spring clip 10 is first mounted on the injector 12 by advancing the open side 22 radially so that flanges 24,26 enter and snap onto the injector groove 36 with the arcuate edges 32,34 firmly gripping groove 36, the injector key 46 extending into aperture 44, and the angled upper portions 50,52,54 disposed axially in the direction of the injector inlet end 56. The injector 12 is then assembled with the fuel rail cup 14 as above described during which the angled portions 50,52 cause the sides 16,18 to spring out slightly. This allows the side walls 16,18 to slide over the flange 42 of the cup 14 until the flange is received in the slots 38,40 which then hold the injector against further axial motion. During this assembly step, the key 48 formed on the cup flange is moved axially into the aperture 44 in the clip side wall 20. This is possible because the upper part of the aperture 44 is angled outward with angled portion 54 of side wall 20 so the key 48 can slide axially into the aperture. Then upon engagement of the flange 42 with slots 38,40, the clip locks the injector 12 to the cup 14, preventing further axial or rotational motion.

Alternatively, if desired, the clip 10 may be installed after assembly of the injector 12 to the cup 14. In this method, the open side 22 of clip 10 is advanced radially toward the injector/clip assembly. Flanges 24,26 enter circumferential groove 36 and the advancing clip 10 spreads the flanges apart to allow them to pass onto the injector. As the clip 10 is being advanced radially toward the injector 12, slots 38,40 pass over the flanged portion 42 of the fuel rail cup 14. At the same time, aperture 44 receives protruding orientation keys 46,48. As the clip 10 is advanced further it snaps onto the assembly to fix the injector 12 against axial and rotational movement relative to the fuel rail cup 14.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A spring clip for retaining together a fuel injector and a fuel rail cup, said clip comprising:

first and second parallel spaced side walls; and a third side wall resiliently connecting said first and second side walls to form a generally U-shaped body with an open side;

said first and second parallel spaced side walls including flanges extending inwardly toward one another from opposed lower edges of said side walls, said flanges being configured to coact with an exterior surface of an associated fuel injector to locate said injector axially relative to said clip;

said first and second parallel spaced side walls also including slots arranged to receive a flanged portion of said fuel rail cup such that said clip is located axially relative to said cup, thereby locating said injector axially relative to said cup;

said third side wall including an aperture for receiving both a radially protruding orientation key of said injector and a corresponding orientation key of said fuel rail cup;

whereby when said injector and said clip are assembled with said fuel rail cup, said clip is effective to fix said injector against axial and rotational movement relative to said fuel rail cup.

2. A spring clip as in claim 1 wherein said flanges include generally arcuate inner edges configured to coact with an associated circumferential groove in the fuel injector exterior surface.

3. A spring clip as in claim 1 wherein said slots are disposed parallel with each other and transverse to the axis of the injector.

4. A spring clip as in claim 1 wherein said aperture is generally rectangular in shape for receiving said orientation keys in mating relationship.

5. A spring clip as in claim 1 wherein said side walls have outwardly angled upper portions that allow the clip to be preinstalled on an injector and to snap onto the cup flange when the injector inlet end is inserted into the cup.

6. A spring clip as in claim 5 wherein said aperture extends into the angled upper portion of the third side wall, thereby forming a radial extension of the aperture that allows axial entry of the orientation key of said cup into said aperture.

7. A spring clip as in claim 1 wherein, after preassembly of said injector into said fuel rail cup, said clip may be snapped onto the assembly to retain the injector against movement in the cup.

* * * * *